US005298477A

United States Patent [19]

Wehrmann et al.

[11] Patent Number: 5,298,477

[45] Date of Patent: Mar. 29, 1994

[54] DYE ACCEPTOR ELEMENT FOR THERMOSULBLIMATION PRINTING

[75] Inventors: Rolf Wehrmann, Krefeld; Robert Bloodworth, Köln, both of Fed. Rep. of Germany; Geert Defieuw, Kessel; Herman Uytterhoeven, Bonheiden, both of Belgium

[73] Assignee: Agfa Gevaert AG, Leverkusen, Fed. Rep. of Germany

[21] Appl. No.: 907,312

[22] Filed: Jul. 1, 1992

[30] Foreign Application Priority Data

Jul. 16, 1991 [DE] Fed. Rep. of Germany ..... 4123546

[51] Int. Cl.[5] ..... B41M 5/035; B41M 5/38

[52] U.S. Cl. ..... 503/227; 428/195; 428/412; 428/913; 428/914

[58] Field of Search ..... 503/227; 428/195, 913, 428/914, 412; 8/471

[56] References Cited

U.S. PATENT DOCUMENTS

| | | | |
|---|---|---|---|
| 4,705,522 | 11/1987 | Byers | 8/471 |
| 4,927,803 | 5/1990 | Bailey | 503/227 |
| 4,982,014 | 1/1992 | Freitag et al. | 528/196 |
| 5,126,428 | 6/1992 | Freitag et al. | 568/721 |

FOREIGN PATENT DOCUMENTS

| | | | |
|---|---|---|---|
| A0227094 | 1/1987 | European Pat. Off. | 503/227 |
| A0228066 | 8/1987 | European Pat. Off. | 503/227 |

*Primary Examiner*—Pamela R. Schwartz

[57] ABSTRACT

Using a dye acceptor element for thermosublimation printing comprising a dye acceptor layer containing a polycarbonate formed from a diphenol of formula I and, optionally, another polymer resin (I)

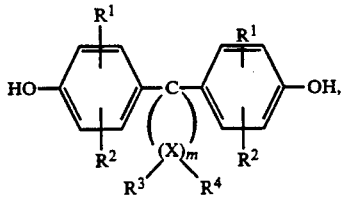

in formula I:

$R^1$ and $R^2$ independently of one another represent hydrogen, halogen, $C_{1-8}$ alkyl, $C_{5-6}$ cycloalkyl, $C_{6-10}$ and aryl and $C_{7-12}$ aralkyl, X represents a carbon atom, m is an integer of 4 to 7, $R^3$ and $R^4$ may be individually selected for each X and independently of one another represent hydrogen or $C_{1-6}$ alkyl with the proviso that, at at least one atom X, $R^3$ and $R^4$ are both alkyl.

5 Claims, No Drawings

DYE ACCEPTOR ELEMENT FOR THERMOSULBLIMATION PRINTING

This invention relates to a dye acceptor element for thermosublimation printing.

Printouts of video- or computer-stored images can be made by a number of methods among which thermosublimation printing has proved to be superior for certain requirements by virtue of its advantages over other processes. In this recording method, a sheet-form or web-form donor material containing a sublimatable dye is brought into contact with a dye acceptor layer and is heated imagewise to transfer the dye.

The thermohead is controlled and the dye transferred from the donor material to the acceptor element in accordance with the stored original. A detailed description of the process can be found, for example, in "High Quality Image Recording by Sublimation Transfer Recording Material", Electronic Photography Association Documents 27 (2), 1988 and in the literature cited therein. A particular advantage of this printing process is that it enables color intensities to be finely graduated.

Dye acceptor elements for thermosublimation printing usually comprise a support, for example paper or transparent films, which is coated with the actual dye acceptor layer. A binder layer can be arranged between the support and the acceptor layer.

Polymers of different classes may be used as the material for the dye acceptor layer.

Thus, the following examples of suitable materials for the acceptor layer are mentioned in EP-A-0 234 563:

1. synthetic resins containing ester compounds, such as polyesters, polyacrylates, polyvinyl acetate, styrene/acrylate resins and vinyl toluene/acrylate resins
2. polyurethanes
3. polyamides
4. urea resins
5. synthetic resins containing other highly polar bonds, such as polycaprolactam, styrene resins, polyvinyl chloride, vinyl chloride/vinyl acetate copolymers and polyacrylonitrile.

Polycarbonate, polyurethane, polyester, polyvinyl chloride, poly(styrene-co-acrylonitrile), polycaprolactone and mixtures thereof are mentioned as materials for the dye acceptor layer in U.S. Pat. No. 4,705,522.

EP-A-0 228 066 describes a dye acceptor layer having improved light stability which contains a mixture of polycaprolactone and a linear aliphatic polyester with poly(styrene-co-acrylonitrile) and/or bisphenol A polycarbonate.

EP-A-0 227 094 describes a dye acceptor element based on bisphenol A polycarbonate which, despite a molecular weight of the polycarbonate of more than 25,000, can be processed to layers having only very slight surface roughness. U.S. Pat. No. 4,927,803 describes a polycarbonate receptor layer in which the polycarbonate is synthesized from bisphenol A and non-aromatic diols.

The dye acceptor layers available at the present time are not entirely satisfactory in regard to high color density, adequate image stability and good resolution. It is particularly difficult in this regard to achieve high color density and adequate image stability for minimal lateral diffusion.

The problem addressed by the present invention was to provide a dye acceptor element for thermosublimation printing which would not have any of the disadvantages described above. This problem has been solved by the use of a special polymer in the dye acceptor element.

The present invention relates to a dye acceptor element for thermosublimation printing comprising a support and, arranged on the support, a dye acceptor layer containing aromatic polycarbonate, characterized in that the polycarbonate contains at least 10 recurring structural units formed from a bis-(hydroxyphenyl)-cycloalkane (diphenol) corresponding to formula I:

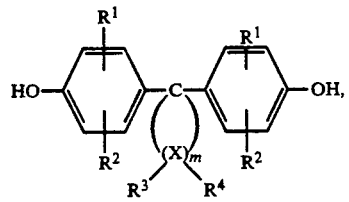

(I)

in which $R^1$ and $R^2$ independently of one another represent hydrogen, halogen, $C_{1-8}$ alkyl, $C_{5-6}$ cycloalkyl, $C_{6-10}$ aryl and $C_{7-12}$ aralkyl, X represents a carbon atom, m is an integer of 4 to 7, $R^3$ and $R^4$ may be individually selected for each X and independently of one another represent hydrogen or $C_{1-6}$ alkyl with the proviso that, at at least one atom X, both $R^3$ and $R^4$ are both alkyl.

Preferably at 1 to 2 atoms X and, more particularly, at only 1 atom X, both $R^3$ and $R^4$ are alkyl. The preferred alkyl radical is methyl. The X atoms in the α-position to the diphenyl-substituted C atom (C-1) are preferably not dialkyl-substituted, whereas the X atoms in the β-position to C-1 are preferably dialkyl-substituted.

Preferred examples of the diphenols used are those containing 5 and 6 ring C atoms in the cycloaliphatic radical (m=4 or 5 in formula (I)), for example diphenols corresponding to the following formulae

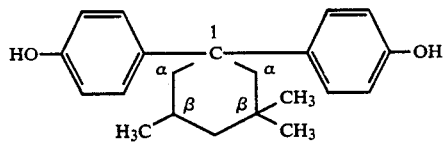

(II)

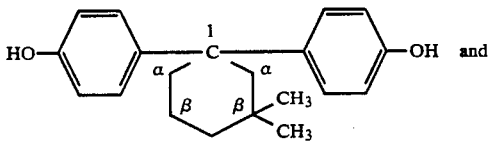

(III)

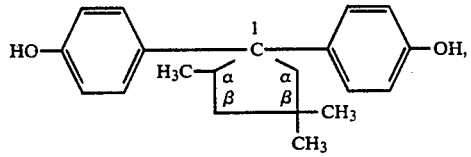

(IV)

the 1,1-bis-(4-hydroxyphenyl)-3,3,5-trimethyl cyclohexane (II) being particularly preferred.

The bis-(hydroxyphenyl)-cycloalkanes corresponding to formula (I) may be obtained in known manner by condensation of phenols corresponding to formula (V)

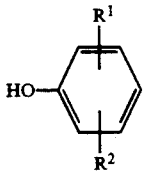

(V)

and ketones corresponding to formula (VI)

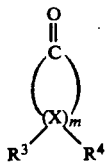

(VI)

where X, $R^1$, $R^2$, $R^3$, $R^4$ and m are as defined for formula (I).

The phenols corresponding to formula (V) are either known from the literature or may be obtained by methods known from the literature (for cresols and xylenols, see for example Ullmanns Encyklopädie der technischen Chemie, 4th Revised and Extended Edition, Vol. 15, pages 61–77, Verlag Chemie, Weinheim/New York, 1978; for chlorophenols, Ullmanns Encyklopädie der technischen Chemie, 4th Edition, Verlag Chemie, 1975, Vol. 9, pages 573–582; and for alkylphenols, Ullmanns Encyklopädie der technischen Chemie, 4th Edition, Verlag Chemie 1979, Vol. 18, pages 191–214).

Examples of suitable phenols corresponding to formula (V) are phenol, o-cresol, m-cresol, 2,6-dimethylphenol, 2-chlorophenol, 3-chlorophenol, 2,6-dichlorophenol, 2-cyclohexylphenol, diphenylphenol and o- or p-benzylphenols.

The ketones corresponding to formula (VI) are known from the literature (cf. for example Beilsteins Handbuch der Organischen Chemie, Vol. 7, 4th Edition, Springer-Verlag, Berlin, 1925 and the corresponding Supplementary Volumes 1 to 4 and J. Am. Chem. Soc. Vol. 79 (1957), pages 1488, 1490 and 1491, U.S. Pat. No. 2,692,289, Allen et al., J. Chem. Soc., (1954), 2186, 2191 and J. Org. Chem. Vol. 38, No. 26, (1973), pages 4431 et seq., J. Am. Chem. Soc. 87, (1965), pages 1353 et seq., more especially page 1355). A general process for the production of ketones corresponding to formula (VI) is described, for example, in "Organikum", 15th Edition, 1977, VEB-Deutscher Verlag der Wissenschaften, Berlin, for example on page 698.

The following are examples of known ketones corresponding to formula (VI): 3,3-dimethylcyclopentanone, 2,2-dimethylcyclohexanone, 3,3-dimethylcyclohexanone, 4,4-dimethylcyclohexanone, 3-ethyl-3-methylcyclopentanone, 2,3,3-trimethylcyclopentanone, 2,4,4-trimethylcyclopentanone, 3,3,4-trimethylcyclopentanone, 3,3-dimethylcycloheptanone 4,4-dimethylcycloheptanone, 3-ethyl-3-methylcyclohexanone, 4-ethyl-4-methylcyclohexanone, 2,3,3-trimethylcyclohexanone, 2,4,4-trimethylcyclohexanone, 3,3,4-trimethylcyclohexanone, 2,5,5-trimethylcyclohexanone, 3,3,5-trimethylcyclohexanone, 3,4,4-trimethylcyclohexanone, 2,3,3,4-tetramethylcyclopentanone, 2,3,4,4-tetramethylcyclopentanone, 3,3,4,4-tetramethylcyclopentanone, 2,2,5-trimethylcycloheptanone, 2,2,6-trimethylcycloheptanone, 2,6,6-trimethylcycloheptanone, 3,3,5-trimethylcycloheptanone, 3,5,5-trimethylcycloheptanone, 5-ethyl-2,5-dimethylcycloheptanone, 2,3,3,5-tetramethylcycloheptanone, 2,3,5,5-tetramethylcycloheptanone, 3,3,5,5-tetramethylcycloheptanone, 4-ethyl-2,3,4-trimethylcyclopentanone, 2-isopropyl-4,4-dimethylcyclopentanone, 4-isopropyl-2,4-dimethylcyclopentanone, 2-ethyl-3,5,5-trimethylcyclohexanone, 3-ethyl-3,5,5-trimethylcyclohexanone, 3-ethyl-4-isopropyl-3-methylcyclopentanone, 4-sec.-butyl-3,3-dimethylcyclopentanone, 2-isopropyl-3,3,4-trimethylcyclopentanone, 3-ethyl-4-isopropyl-3-methylcyclohexanone, 4-ethyl-3-isopropyl-4-methylcyclohexanone, 3-sec.-butyl-4,4-dimethylcyclohexanone, 3-isopropyl-3,5,5-trimethylcyclohexanone, 4-isopropyl-3,5,5-trimethylcyclohexanone, 3,3,5-trimethyl-5-propylcyclohexanone, 3,5,5-trimethyl-5-propylcyclohexanone, 2-butyl-3,3,4-trimethylcyclopentanone, 2-butyl-3,3,4-trimethylcyclohexanone, 4-butyl-3,3,5-trimethylcyclohexanone, 3-isohexyl-3-methylcyclohexanone, 5-ethyl-2,4-diisopropyl-5-methylcyclohexanone, 2,2-dimethylcyclooctanone and 3,3,8-trimethylcyclooctanone.

The following are examples of preferred ketones:

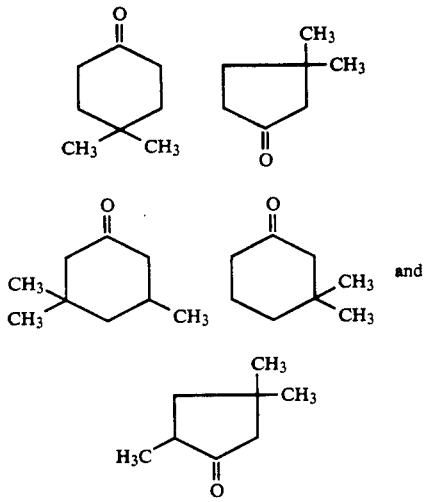

The production of suitable diphenols (I) is described, for example, in DE-A-3 832 396. The diphenols are used for the production of high molecular weight thermoplastic aromatic polycarbonates (polycarbonates according to the invention).

It is possible to use both a single diphenol corresponding to formula (I), in which case homopolycarbonates are formed, and also several diphenols corresponding to formula (I), in which case copolycarbonates are formed.

In addition, the diphenols (I) may also be used in admixture with other diphenols, for example with those corresponding to the formula HO-Z-OH (VII), for the production of high molecular weight, thermoplastic aromatic polycarbonates.

Suitable other diphenols corresponding to the formula HO-Z-OH (VII) are those in which Z is an aromatic radical containing 6 to 30 C atoms which may contain one or more aromatic nuclei, may be substituted and may contain aliphatic radicals or other cycloaliphatic radicals than those corresponding to formula (I) or heteroatoms as bridge members.

Examples of diphenols corresponding to formula (VII) are hydroquinone, resorcinol, dihydroxydiphenyls, bishydroxyphenyl)-alkanes, bis-(hydroxyphenyl)-cycloalkanes, bis-(hydroxyphenyl)-sulfides, bis-(hydroxyphenyl)-ethers, bis-(hydroxyphenyl)-ketones, bis- (hydroxyphenyl)-sulfones, bis-(hydroxyphenyl)-sulfoxides, α,α'-bis-(hydroxyphenyl)-diisopropylbenzenes and nucleus-alkylated and nucleus-halogenated compounds thereof.

These and other suitable other diphenols are described, for example, in U.S. Pat. Nos. 3,028,365, 2,999,835, 3,148,172, 3,275,601, 2,991,273, 3,271,367, 3,062,781, 2,970,131 and 2,999,846; in DE-OS 1 570 703, 2 063 050, 2 063 052, 2 211 0956, in FR-PS 1 561 518 and in the book by H. Schnell entitled "Chemistry and Physics of Polycarbonates", Interscience Publishers, New York, 1964.

Preferred other diphenols are, for example, 4,4'-dihydroxydiphenyl, 2,2-bis-(4-hydroxyphenyl)-propane, 2,4-bis-(4-hydroxyphenyl)-2-methylbutane, 1,1-bis-(4-hydroxyphenyl)-cyclohexane, α,α,'-bis-(4-hydroxyphenyl)-p-diisopropylbenzene, 2,2-bis-(3-methyl-4-hydroxyphenyl)-propane, 2,2-bis-(3-chloro-4-hydroxyphenyl)-propane, bis-(3,5-dimethyl-4-hydroxyphenyl)-methane, 2,2-bis-(3,5-dimethyl-4-hydroxyphenyl)-propane, bis-(3,5-dimethyl-4-hydroxyphenyl)-sulfone, 2,4-bis-(3,5-dimethyl-4-hydroxyphenyl)-2-methylbutane, 1,1-bis-(3,5-dimethyl-4-hydroxyphenyl)cyclohexane, α,α'-bis-(3,5-dimethyl-4-hydroxyphenyl)-p-diisopropylbenzene, 2,2-bis-(3,5-dichloro-4-hydroxyphenyl)propane and 2,2-bis-(3,5-dibromo-4-hydroxyphenyl)-propane.

Particularly preferred diphenols (VII) are, for example, 2,2-bis-(4-hydroxyphenyl)-propane, 2,2-bis-(3,5-dimethyl-4-hydroxyphenyl)-propane, 2,2-bis-(3,5-dichloro-4-hydroxyphenyl)-propane, 2,2-bis-(3,5-dibromo-4-hydroxyphenyl)-propane and 1,1-bis-(4-hydroxyphenyl)-cyclohexane.

2,2-Bis-(4-hydroxyphenyl)-propane is particularly preferred.

The other diphenols may be used both individually and in admixture with one another.

Where other diphenols are used in addition to the diphenols (I) in the production of the polycarbonates used in accordance with the invention, the quantity of diphenol (I) in the diphenol mixture is at least 2 mol-%, preferably at least 5 mol-% and, more preferably, at least 10 mol-%.

The high molecular weight polycarbonates according to the invention may be produced by known methods for the production of polycarbonates. The various diphenols may be attached to one another both statistically and in blocks.

The branching agents, if any, used to obtain branched polycarbonates are in known manner small quantities, preferably of from 0.05 to 2.0 mol-% (based on diphenols used), of trifunctional or more than trifunctional compounds, particularly those containing three or more than three phenolic hydroxyl groups. Some of the compounds containing three or more than three phenolic hydroxyl groups which may be used are phloroglucinol, 4,6-dimethyl-2,4,6-tri-(4-hydroxyphenyl)-hept-2-ene, 4,6-dimethyl-2,4,6-tri-(4-hydroxyphenyl)-heptane, 1,3,5-tri-(4-hydroxyphenyl)-benzene, 1,1,1-tri-(4-hydroxyphenyl)-ethane, tri-(4-hydroxyphenyl)-phenylmethane, 2,2-bis-(4,4-bis-(4-hydroxyphenyl)cyclohexyl)-propane, 2,4-bis-(4-hydroxyphenylisopropyl)phenol, 2,6-bis-(2-hydroxy-5'-methylbenzyl)-4-methylphenol, 2-(4-hydroxyphenyl)-2-(2,4-dihydroxyphenyl)-propane, hexa-(4-(4-hydroxyphenylisopropyl)-phenyl)-orthoterephalic acid ester, tetra-(4-hydroxyphenyl)-methane, tetra-(4-(4-hydroxyphenylisopropyl)-phenoxy)-methane and 1,4-bis-((4',4''-dihydroxytriphenyl)-methyl)-benzene.

Some of the other trifunctional compounds are 2,4-dihydroxybenzoic acid, trimesic acid, cyanuric chloride and 3,3-bis-(3-methyl-4-hydroxyphenyl)-2-oxo-2,3-dihydroindole.

Monofunctional compounds in the usual concentrations may be used in known manner as chain terminators for regulating molecular weight. Suitable compounds are, for example, phenol, tert.-butylphenols or other alkyl-$C_{1-7}$-substituted phenols. Small quantities of phenols corresponding to formula (VIII)

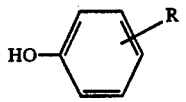

(VIII)

in which R is a branched $C_8$ and/or $C_9$ alkyl radical, are particularly suitable for regulating molecular weight. In the alkyl radical R, the percentage of $CH_3$ protons is between 47 and 89% and the percentage of CH and $CH_2$ protons between 53 and 11%. R is preferably in the o- and/or p-position to the OH group, 20% being the particularly preferred upper limit to the ortho component. The chain terminators are generally used in quantities of from 0.5 to 10 mol-% and preferably in quantities of from 1.5 to 8 mol-%, based on the diphenols used.

The polycarbonates according to the invention may be produced in known manner, preferably by the interfacial process (cf. H. Schnell "Chemistry and Physics of Polycarbonates", Polymer Reviews, Vol. IX, pages 33 et seq., Interscience Publ., 1964). In this process, the diphenols are dissolved in aqueous alkaline phase. To prepare copolycarbonates with other diphenols, mixtures of diphenols corresponding to formula (I) and the other diphenols are used. Chain terminators may be added to regulate molecular weight. The reaction is then carried out with phosgene by the interfacial condensation method in the presence of an inert, preferably polycarbonate-dissolving, organic phase. The reaction temperature is in the range from 0° to 40° C.

The branching agents optionally used (0.05 to 2 mol-%) may be initially introduced either with the diphenols in the aqueous alkaline phase or may be added in solution in the organic solvent before the phosgenation.

In addition to the diphenols to be used, mono- and/or bis-chlorocarbonic acid esters thereof may also be used, being added in solution in organic solvents. The quantity of chain terminators and branching agents used is then determined by the molar quantity of diphenolate structural units. Where chlorocarbonic acid esters are used, the quantity of phosgene may be reduced accordingly in known manner.

Suitable organic solvents for the chain terminators and, optionally, for the branching agents and the chlorocarbonic acid esters are, for example, methylene chloride, chlorobenzene, acetone, acetonitrile and mixtures of these solvents, particularly mixtures of methylene chloride and chlorobenzene. The chain terminators and branching agents used may optionally be dissolved in the same solvent.

The organic phase for the interfacial polycondensation may be formed, for example, by methylene chloride, chlorobenzene and by mixtures of methylene chloride and chlorobenzene.

Aqueous NaOH solution for example is used as the aqueous alkaline phase.

The production of the polycarbonates by the interfacial process may be catalyzed in the usual way by such catalysts as tertiary amines, particularly tertiary aliphatic amines, such as tributylamine or triethylamine. The catalysts may be used in quantities of from 0.05 to 10 mol-%, based on mols diphenols used. The catalysts may be added before the beginning of phosgenation or during or even after phosgenation.

The polycarbonates according to the invention are isolated in known manner.

The polycarbonates used in accordance with the invention may also be produced by the known homogeneous-phase process, the so-called "pyridine process", and also by the known melt transesterification process using diphenyl carbonate, for example, instead of phosgene. In this case, too, the polycarbonates according to the invention are isolated in known manner.

The polycarbonates preferably have molecular weights $\overline{M}w$ (weight average, as determined by gel chromatography after preliminary calibration) of at least 5,000 and, more preferably, in the range from 8,000 to 200,000 and, most preferably in the range from 10,000 to 80,000.

Polycarbonates based on cycloaliphatic bisphenols are known in principle and are described, for example, in EP-A-0 164 476, DE-A-33 45 945, DE-A-20 63 052, FR-A-14 27 998, WP 80 00 348, BE 785 189.

The polycarbonates used in accordance with the invention have higher glass transition temperatures than pure BPA polycarbonate.

High glass transition temperatures have a positive effect on unwanted lateral diffusion (bleeding). By virtue of their higher glass transition temperatures, dye acceptor elements containing the polycarbonates according to the invention are suitable, for example, for the production of color filters by thermosublimation printing, as described in EP-A-0 391 303. Improved solubility of the polycarbonates is achieved through the higher percentage content of alkyl groups. Thus, the polycarbonates mentioned in Examples 1 to 4 are soluble in the ecologically safe solvents MEK or butyl acetate, which is a distinct advantage over pure BPA polycarbonate.

The higher percentage content of cycloaliphatic groups compared with pure BPA-PC provides for better compatibility with other aliphatic products, such as blend partners or low molecular weight plasticizers or even with the dyes transferred in the printing process.

The polycarbonates may also be used in admixture with other known resins for dye acceptor layers. For example, the following polymers a) to e)—either individually or in admixture—may be used in combination with the polycarbonates according to the invention as dye receptor material:

a) Polymers containing ester bonds: for example polyesters, polyacrylates, polycarbonates, polyvinyl acetate, polyvinyl propionate, styrene acrylates, methyl styrene acrylates.
b) Polymers containing urethane bonds: for example polyurethanes, polyester urethanes.
c) Polymers containing amide bonds: for example polyamides, polyester amides.
d) Polymers containing urea bonds: for example polyureas.
e) Polymers containing other highly polar bonds, such as for example polycaprolactone, polystyrenes, polyvinyl alcohol, polyvinyl chloride, polyacrylonitrile, polyethers, polysulfones, polyether ketones, polyhydantoin, polyimides, styrene/MA copolymers, cellulose derivatives.
f) Polymers bearing functional groups optionally capable of crosslinking, such as for example —OH, —NHz, —NHR, —COOH, —SH, —NCO,

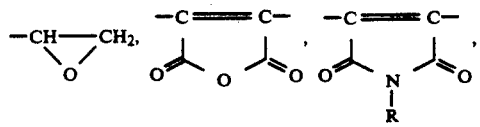

and polymers which have been obtained by crosslinking reactions involving such functional groups.

Examples of such resins can be found, for example, in EP-A-0 227 094, EP-A-0 228 066, EP-A-0 133 011, EP-A-0 133 012, EP-A-0 144 247 or EP-A-0 368 320.

In cases where the polycarbonates according to the invention are used in combination with other resins of the type mentioned above in the dye acceptor layer, the percentage content of the other resins in the mixture as a whole is between 0 and 98% by weight.

High-boiling solvents or plasticizers may also be added to the dye acceptor layer and may provide, for example, for more homogeneous diffusion or rather distribution of the transferred dyes.

Suitable plasticizers are, for example, dimethyl phthalate/isophthalate, diethyl phthalate/isophthalate, dipropyl phthalate/isophthalate, dibutyl phthalate/isophthalate, dihexyl phthalate/isophthalate, diethyl hexyl phthalate/isophthalate, diphenyl phthalate/isophthalate, dioctyl phthalate/isophthalate, didecyl phthalate/isophthalate, diisodecyl phthalate/isophthalate and the corresponding terephthalates. In addition to adipic acid polyesters and other aliphatic polyesters, mixed esters, such as benzyl butyl phthalate/isophthalate, benzyl octyl adipate, diphenyl cresyl phosphate, diphenyl octyl phosphate and alkyl sulfonates are also suitable plasticizers.

In addition, fatty alcohols, amines and acids and also derivatives thereof, such as for example stearic acid, stearyl alcohol, stearyl amine, myristic acid, myristyl alcohol, cetyl alcohol, glycerol monostearate, pentaerythritol partial ester, pentaerythritol tetrastearate, are also mentioned as plasticizers.

Useful representatives of these compounds can be found, for example, in JP 62/174 754, JP 62/245 253, JP 61/209 444, JP 61/200 538, JP 62/136 646, JP 62/30 274, U.S. Pat. No. 4,871,715.

The dye acceptor layer may contain pigments or mixtures of several pigments, such as for example titanium dioxide, zinc oxide, kaolin, clay, calcium carbonate or Aerosil, in order for example to increase image sharpness or to improve whiteness.

If necessary, various types of additives, such as for example UV absorbers, light stabilizers or antioxidants, may be added in order further to increase the light stability of the transferred image.

The dye acceptor layers according to the present invention may contain a lubricant to improve the abhesive properties, primarily between the donor element and the acceptor element. For example, solid waxes, such as polyethylene wax, amide waxes or Teflon powder may be used for this purpose, although fluorine-containing surfactants, paraffin oils, silicone oils or fluorine-containing oils or silicone-containing copolymers, such as polysiloxane/polyether copolymers, may also be used as lubricants. Reactive modified silicones may also be used. Products such as these may contain carboxyl, amino and/or epoxide groups and, with a suitable combination of amino and epoxy silicone for example, lead to crosslinked abhesive layers.

The lubricant mentioned may even be applied as a separate coating, for example in the form of a dispersion or from a suitable solvent, optionally as a top coat. The thickness of such a layer is preferably from 0.01 to 5 μm and more preferably from 0.05 to 2 μm.

Various materials may be used as supports for the dye acceptor layers. It is possible to use transparent films, such as for example polyethylene terephthalate, polycarbonate, polyether sulfone, polyolefin, polyvinyl chloride, polystyrene, cellulose or polyvinyl alcohol copolymer films. Reflective supports, such as the various types of papers, for example polyolefin-coated paper or pigmented papers, may of course also be used. Laminates of the materials mentioned above are also suitable supports. Typical combinations are laminates of cellulose paper and synthetic paper or cellulose paper and polymer films or polymer films and synthetic paper or even other combinations.

The supports provide for the necessary mechanical stability of the dye acceptor element. If the dye acceptor layer has sufficient mechanical stability, there may be no need for an additional support.

The dye acceptor layers according to the present invention preferably have overall layer thicknesses of 0.3 to 50 μm and, more preferably, 0.5 to 10 μm where a support of the type described above is used or—in the absence of such a support—3 to 120 μm. The dye acceptor layer may consist of a single layer although two or more layers may also be applied to the support. Where transparent supports are used, they may be coated on both sides to increase color intensity, as described for example in European patent application 90 200 930.7.

The dye acceptor element according to the present invention may also contain various interlayers between the support and the dye acceptor layer. Depending on the specific properties of the material used, the interlayer may act as an elastic layer, as a barrier layer for the dye transferred or even as a binder layer, depending on the particular application. Suitable materials are, for example, urethane, acrylate or olefin resins and also butadiene rubbers or epoxides. An interlayer may also contain, for example, a polymer having an inorganic polymer chain made up of silicon, titanium or zirconium oxide, as described for example in U.S. Pat. No. 4,965,238, U.S. Pat. No. 4,965,239, U.S. Pat. No. 4,965,241. The thickness of this interlayer is normally between about 1-2 and 20 μm. The function of the diffusion barrier layers is to prevent the transferred dyes from diffusing into the support. Materials which perform this function may be soluble in water or in organic solvents or in mixtures, but preferably in water. Suitable materials are, for example, gelatine, polyacrylic acid, maleic anhydride copolymers, polyvinyl alcohol or cellulose acetate.

The additional layers optionally present, such as the elastic layer, the diffusion barrier layer, the binder layer, etc., and the actual dye acceptor layer may contain, for example, silicate, clay, aluminium silicate, calcium carbonate, calcium sulfate, barium sulfate, titanium dioxide or aluminium oxide powder.

The dye acceptor elements according to the invention may also be antistatically treated in the usual way on the front or back. In addition, they may be provided with markings, preferably on the back of the support, in order to achieve exact positioning during the printing process.

The dye acceptor element according to the invention may be combined with any of the dye donor elements typically used in thermosublimation printing.

The dye images obtained in a thermosublimation printer are distinguished by high resolution, high color densities, high brilliance and good long-term stability.

The dye acceptor layers containing the polycarbonate according to the invention are normally produced from solution. Suitable solvents are, for example, methyl ethyl ketone (MEK), butyl acetate, methylene chloride, chlorobenzene, tetrahydrofuran (THF) or dioxolane. The solution may be applied to the support by casting or knife-coating.

EXAMPLES

Polycarbonates were produced from the parts by weight of bisphenol A (BPA) and diphenol prepared from 3,3,5-trimethylcyclohexanone (TMC diphenol) shown in Table 1 by the method according to DE-A-3 832 396.

TABLE 1

| Example | BPA | TMC Diphenol |
|---|---|---|
| 1 | 65 | 35 |
| 2 | 55 | 45 |
| 3 | 45 | 55 |
| 4 | — | 100 |

EXAMPLES OF DYE RECEPTOR LAYERS a) Polycarbonate containing low molecular weight plasticizers 10% solutions in MEK were produced from the polycarbonates obtained. The solutions were knife-coated in a wet film thickness of 20 μm onto a paper which had been coated on both sides with polyethylene and to one side of which a gelatine layer was additionally applied over the polyethylene. A layer was applied to that side. The coatings were dried for 30 minutes at 70° C. in a recirculating air drying cabinet. A 0.5% solution in ethanol of Tego Glide 410 (Goldschmidt) was then applied in a wet film thickness of 24 μm and was dried at 70° C. in a recirculating air drying cabinet.

Test images were produced on the dye receptor elements obtained with a Mitsubishi CP-100 E Videoprinter using a Mitsubishi CK-100 S dye cassette.

| Example | PC-1 % by wt. | Additive % by wt. |
|---|---|---|
| 5 | 66⅔ | 33⅓ glycerol monostearate |
| 6 | 90 | 10 glycerol monostearate |
| 7 | 66⅔ | 33⅓ pentaerythritol tetrastearate |
| 8 | 90 | 10 pentaerythritol tetrastearate |
| 9 | 90 | 10 alkyl sulfonic acid ester |
| 10 | 90 | 10 benzyl octyl adipate |
| 11 | 90 | 10 benzyl butyl phthalate |
| 12 | 90 | 10 dioctyl phthalate |
| 13 | 90 | 10 diisodecyl phthalate |
| 14 | 90 | 10 diphenyl cresyl phosphate |
| 15 | 90 | 10 diphenyl octyl phosphate |

PC-1 = polycarbonate (PC) of Example 4 b) Blends of polycarbonate and other thermoplastics (processed as described under a))

| Example | PC-1 % by wt. | Additive % by wt. |
|---|---|---|
| 16 | 90 | 10 polycaprolactone |
| 17 | 66⅔ | 33⅓ polycaprolactone |
| 18 | 90 | 10 adipic acid polyester |
| 19 | 90 | 10 phthalic acid polyester |

The dye acceptor layers of Examples 5 to 19 are distinguished by increased color density, a reduced tendency towards adhesion and high stability to temperature conditions.

c) Blends of polycarbonate with several components (processed as described in a); quantities in % by weight)

| Ex. | PC-1 | PC-2 | Vinylite VAGD | Desmodur VL | Tegomer H SI 2110 |
|---|---|---|---|---|---|
| 20 | 17 | — | 67 | 13 | 3 |
| 21 | 34 | — | 50 | 13 | 3 |
| 22 | 50 | — | 34 | 13 | 3 |
| 23 | — | 17 | 67 | 13 | 3 |
| 24 | — | 34 | 50 | 13 | 3 |
| 25 | — | 50 | 34 | 13 | 3 |

PC-2 = polycarbonate (PC) of Example 1

Vinylite VAGD is an OH-functional PVC copolymer of Union Carbide, OH content 2.3% by weight Desmodur VL is an aromatic polyisocyanate based on diphenylmethane diisocyanate of Bayer AG, NCO content approx. 31.5% by weight.

Tegomer H SI 2110 is a hydroxyfunctional silicone of Goldschmidt

The dye acceptor layers of Examples 20 to 25 are distinguished by high color densities, a minimal tendency towards adhesion and very good stability after heating.

We claim:

1. A dye acceptor element for thermosublimation printing in combination with a dye donor element, said dye acceptor element comprising a support and a dye acceptor layer arranged on the support wherein said dye acceptor layer contains a) a polycarbonate containing at least 10 recurring structural units formed from a bis-(hydroxyphenyl)cycloalkane corresponding to formula I:

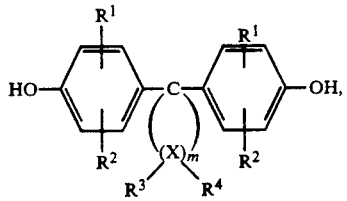

(I)

in which $R^1$ and $R^2$ independently of one another represent hydrogen, halogen, $C_{1-8}$ alkyl, $C_{5-6}$ cycloalkyl, $C_{6-10}$ aryl $C_{7-12}$ aralkyl, X represents a carbon atom, m is an integer of 4 to 7, $R^3$ and $R^4$ can be individually selected for each X and independently of one another represent hydrogen or $C_{1-6}$ alkyl with the proviso that, at at least one atom X, $R^3$ and $R^4$ are both alkyl;

in admixture with b) at least one other polymer selected from the group consisting of: polymers containing ester bonds, polymers containing urethane bonds, polymers containing amide bonds, polymers containing urea bonds, polycaprolactone, polystyrenes, polyvinyl alcohol, polyvinyl chloride, polyacrylonitrile, polyethers, polysulfones, polyether ketones, polyhydantoin, polyimides, styrene/maleic acid copolymers, and cellulose-containing polymers, or c) a low molecular weight plasticizer, wherein said polycarbonate formed from said bis-(hydroxyphenyl)-cycloalkane is present in the dye acceptor layer in a quantity of at least 2% by weight.

2. A combination as claimed in claim 1, wherein the polycarbonate is formed from a bis-(hydroxyphenyl)-cycloalkane corresponding to formula (I) or from a diphenol mixture in which the bis-(hydroxyphenyl)-cycloalkane corresponding to formula (I) is present in a quantity of at least 2 mol-%.

3. A combination as claimed in claim 1, wherein said other polymer contains additionally at least one of the following groups capable of crosslinking: hydroxyl, primary amino, secondary amino, carboxyl, mercapto, or isocyanato.

4. A combination as claimed in claim 3, wherein said groups capable of crosslinking are crosslinked.

5. A method of thermosublimation printing comprising the step of: accepting the heat-transfer of a sublimatable dye with a dye acceptor element, said dye acceptor element comprising a support and a dye acceptor layer arranged on the support, wherein said dye acceptor layer contains a) a polycarbonate containing at least 10 recurring structural units formed from a bis-(hydroxyphenyl)cycloalkane corresponding to formula I:

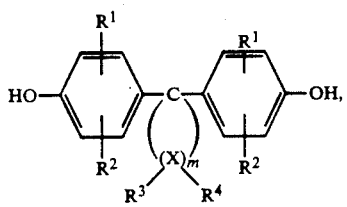

(I)

in which $R^1$ and $R^2$ independently of one another represent hydrogen, halogen, $C_{1-8}$ alkyl, $C_{5-6}$ cycloalkyl, $C_{6-10}$ aryl $C_{7-12}$ aralkyl, X represents a carbon atom, m is an integer of 4 to 7, $R^3$ and $R^4$ can be individually selected for each X and independently of one another represent hydrogen or $C_{1-6}$ alkyl with the proviso that, at at least one atom X, $R^3$ and $R^4$ are both alkyl;

in admixture with b) at least one other polymer selected from the group consisting of: polymers containing ester bonds, polymers containing urethane bonds, polymers containing amide bonds, polymers containing urea bonds, polycaprolactone, polystyrenes, polyvinyl alcohol, polyvinyl chloride, polyacrylonitrile, polyethers, polysulfones, polyether ketones, polyhydantoin, polyimides, styrene/maleic acid copolymers, and cellulose-containing polymers, or c) a low molecular weight plasticizer, wherein said polycarbonate formed from said bis-(hydroxyphenyl)-cycloalkane is present in the dye acceptor layer in a quantity of at least 2% by weight.

* * * * *